US006869371B2

(12) United States Patent
Perry

(10) Patent No.: US 6,869,371 B2
(45) Date of Patent: Mar. 22, 2005

(54) LEG POSITIONING AND TRAINING DEVICE FOR GOLFERS

(76) Inventor: Jack Perry, 66 Clarkes Crossing, Fairport, NY (US) 14450

( * ) Notice: Subject to any disclaimer, the term of this patent is extended or adjusted under 35 U.S.C. 154(b) by 0 days.

(21) Appl. No.: 10/601,367

(22) Filed: Jun. 23, 2003

(65) Prior Publication Data

US 2005/0003899 A1 Jan. 6, 2005

(51) Int. Cl.[7] ..... A63B 69/36

(52) U.S. Cl. ..... 473/272; 473/270; 473/266; 473/269

(58) Field of Search ..... 473/270, 272, 473/266, 269

(56) References Cited

U.S. PATENT DOCUMENTS

| | | | | | |
|---|---|---|---|---|---|
| 2,189,613 | A | * | 2/1940 | Paulsen | 473/270 |
| 3,244,421 | A | * | 4/1966 | Hanna | 473/273 |
| 3,994,501 | A | * | 11/1976 | O'Donnell | 473/269 |
| 4,023,810 | A | * | 5/1977 | Lorang | 473/218 |
| 4,037,847 | A | * | 7/1977 | Lorang | 473/269 |
| 4,147,356 | A | | 4/1979 | Brandell | |
| 4,651,994 | A | | 3/1987 | Lee | |
| 4,657,258 | A | * | 4/1987 | Melov et al. | 473/272 |
| 4,758,001 | A | | 7/1988 | Otring et al. | |
| 5,150,902 | A | | 9/1992 | Heisler | |
| 5,203,569 | A | | 4/1993 | Rilling | |
| 5,318,290 | A | * | 6/1994 | Sawyer | 473/217 |
| 5,334,028 | A | | 8/1994 | Melligan | |
| 5,591,090 | A | | 1/1997 | Kauffman, Jr. | |
| 5,762,565 | A | | 6/1998 | Milam et al. | |
| 5,779,557 | A | * | 7/1998 | Scannell et al. | 473/269 |
| 5,830,079 | A | | 11/1998 | Hudson | |
| 5,987,982 | A | | 11/1999 | Wenman et al. | |
| 6,024,656 | A | | 2/2000 | Lane | |
| 6,033,370 | A | | 3/2000 | Reinbold et al. | |
| 6,120,386 | A | | 9/2000 | Hill | |
| 6,312,345 | B1 | | 11/2001 | Pelz | |
| 6,402,635 | B1 | | 6/2002 | Nesbit et al. | |
| 6,616,556 | B1 | * | 9/2003 | Osmudsen | 473/452 |
| 6,638,176 | B1 | * | 10/2003 | Hayes et al. | 473/266 |
| 6,743,111 | B2 | * | 6/2004 | Mindlin | 473/218 |

* cited by examiner

*Primary Examiner*—Raleigh W. Chiu
(74) *Attorney, Agent, or Firm*—David W. Pettis, Jr.

(57) ABSTRACT

A leg positioning and training device for a golfer is disclosed. The device is characterized by the structure including platform having a foot base plate rotatably mounted thereon for the golf's rear foot, wherein the foot base plate is adjustable in two planes. The footbase plate includes a segment that extends upwardly from the base plate in receiving relation to the user's foot and ankle, and this segment is angularly adjustable with respect to a plane that is substantially normal to the foot base plate. A strain gauge is operatively attached to that segment for receiving and measuring force applied by the user, and a display indicator is provided in operative connection to the strain gauge, whereby the user may see a representation of the force applied thereto during a golf swing.

7 Claims, 4 Drawing Sheets

LEG POSITIONING AND TRAINING DEVICE FOR GOLFERS

BACKGROUND OF THE INVENTION

1. Field of the Invention

The present invention relates to a leg positioning and training device useful for golfers in achieving proper weight shift during a golf swing. The device of this invention comprises a platform having a rotatable foot base plate attached thereto. Extending upwardly from the foot base plate, and angularly adjustable with regard to a plane normal to the foot base plate, is an ankle support. The foot base plate and the ankle support receive the back foot and ankle of the golfer as he or she stands to address the ball. Operatively attached to the ankle support is a strain gauge that is responsive to pressure applied to the ankle support by the golfer during the course of the golf swing. The strain gauge is operatively connected to an indicator that is mounted on the platform such that it is visible to the golfer during and after the golf swing. By calibrating the strain gauge to a series of a lights on the indicator, one may observe the relative amount of pressure applied to the ankle support during the golf swing, and make necessary adjustments so that weight shift is appropriate for properly striking the golf ball.

2. Description of the Prior Art

Given the extreme popularity of the game of golf, worldwide, one can easily find literally hundreds, if not thousands, of golf training aids that are promoted as being useful in teaching a golfer a correct swing and in training the golfer to repeat a proper swing. Such devices are readily available in retail stores and pro-shops, and a large number of the prior art devices are taught in prior patent literature. Some devices are actually worn by the golfer, while others might be described as almost a "cage" in which the golfer stands while practicing and perfecting the golf swing.

Notwithstanding the large number of such devices that are known in the prior art, there remains a need for a device that is simple, easily transported, durable, and capable of providing virtually instantaneous feedback to the user.

The present invention particularly addresses proper positioning of the golfer's rear foot and leg, while providing an immediate, visible indication of weight shift onto that back leg during the golf swing. If the weight shift is excessive, a visible indicator provides this information to the golfer so that correction can be made. If the weight shift is appropriate for a proper golf swing, an immediate visible indicator to that effect is displayed, whereby the golfer can continue his or her practice swings in order to perfect proper weight shift.

SUMMARY OF THE INVENTION

The present invention relates to a leg positioning and training device for golfers and comprises a platform having a top surface and a bottom surface. A foot base plate is rotatably mounted to the top surface of the platform, and an ankle support is attached to the foot base plate. The ankle support includes a segment extending upwardly from the foot base plate, and that segment is angularly adjustable with respect to a plane that is substantially normal to the top surface of the platform. A strain gauge is operatively attached to that upstanding segment of the ankle support such that force applied thereto by the golfer will be detected and measured by the strain gauge. An indicator is operatively connected to the strain gauge and positioned on the top surface of the platform so that is visible to a user of the device. The indicator includes a plurality of lights, one or more of which will be illuminated depending upon the force applied to the strain gauge through the upstanding segment of the ankle support.

The invention accordingly comprises the features of construction, combinations of elements, and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION OF THE INVENTION

Figure 1:
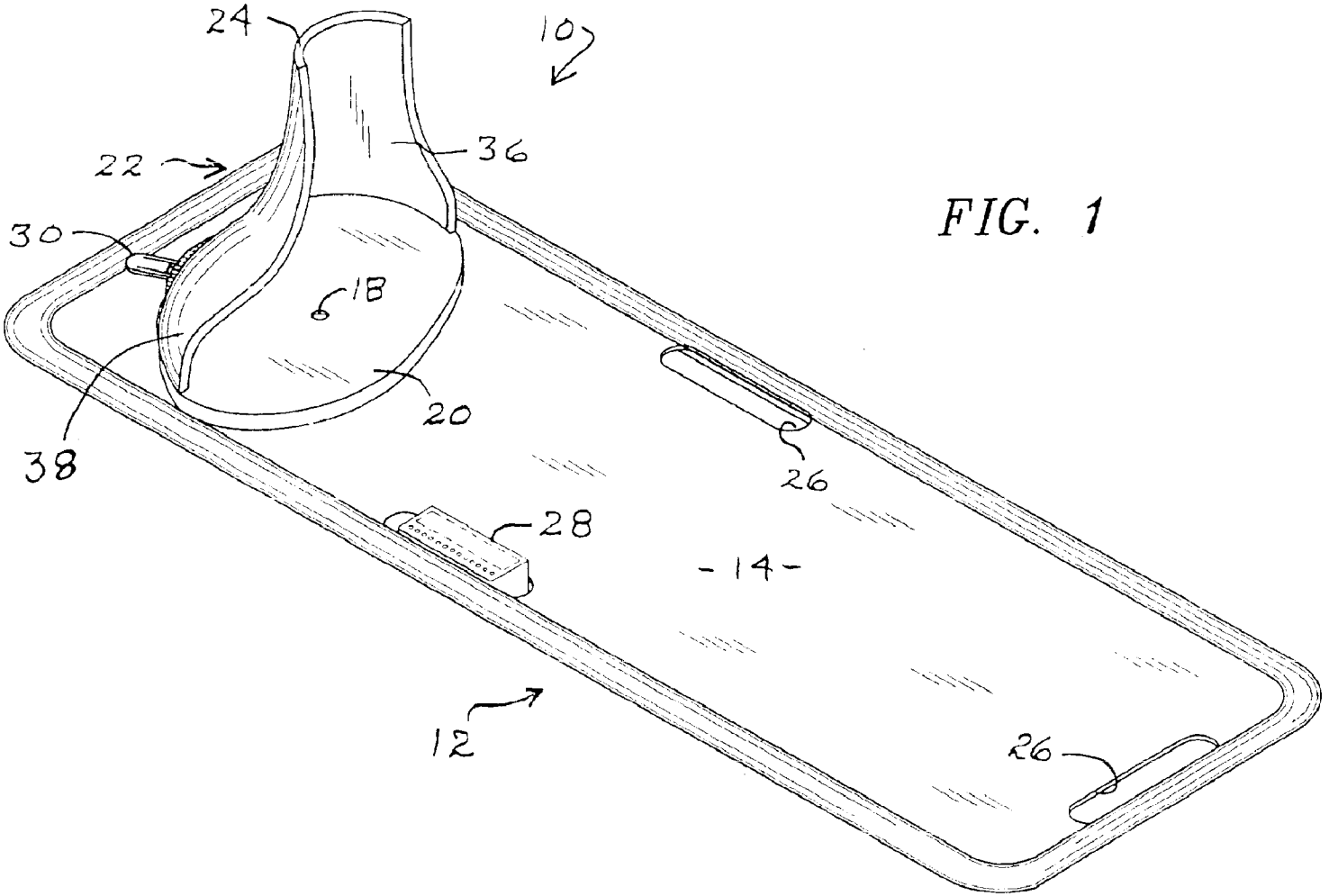
FIG. 1 is a perspective view of the leg positioning and training device of this invention.

Referring to the view of FIG. 1, the leg positioning and training device of this invention is generally indicated as 10. Device 10 comprises a platform, generally indicated as 12, that is substantially rectangular in shape and includes a top surface 14 and a bottom surface 16. Rotatably attached to top surface 14, as by pivot pin 18 is a foot base plate 20. An ankle support, generally indicated as 22, is attached to foot base plate 20 and includes a segment 24 that extends upwardly from foot base plate 20. Also visible in the view of FIG. 1 are handholds 26 for convenience in transporting device 10, an indicator 28 which will be described in greater detail below, and a foot base plate lock 30 which will also be described in greater detail below.

Figure 2:
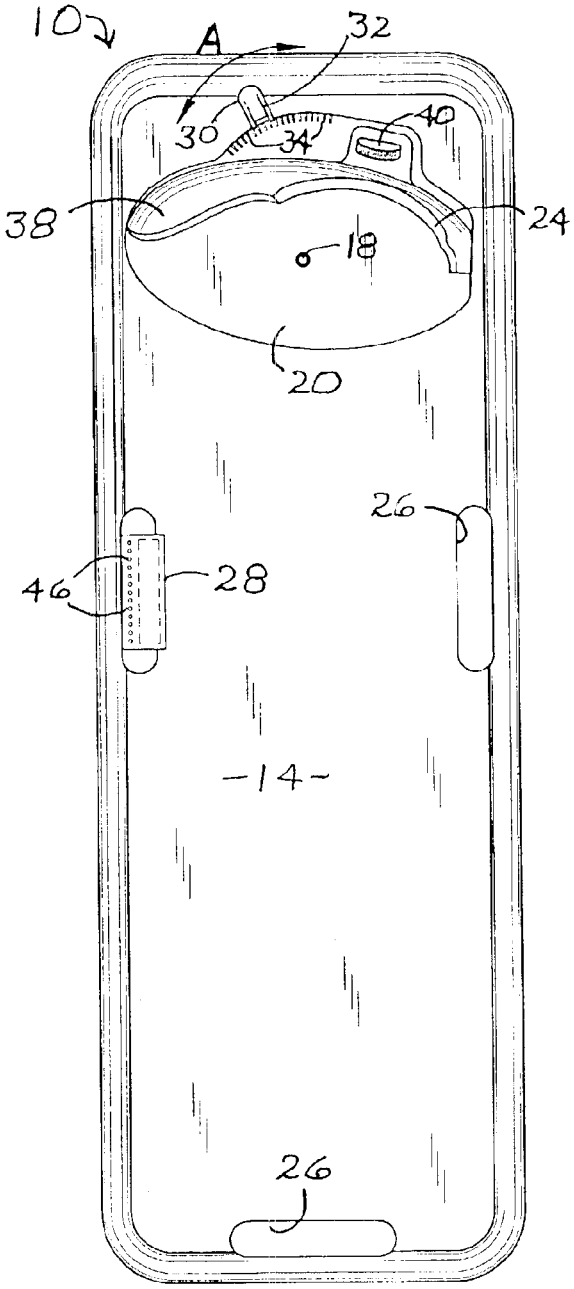
FIG. 2 is a top plan view of the device shown in FIG. 1.
Figure 3:
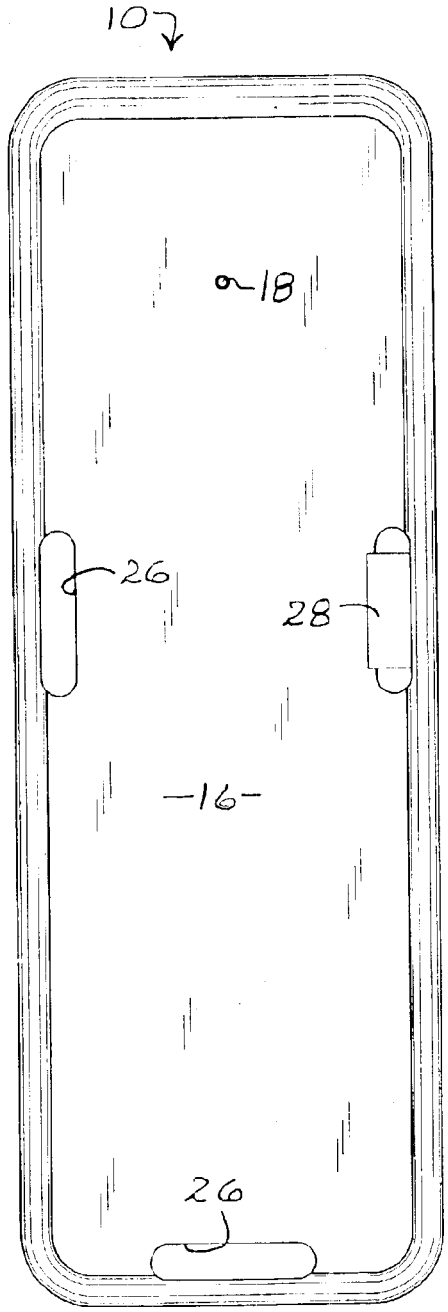
FIG. 3 is a bottom plan view of the device shown in FIG. 1.
Figure 4:
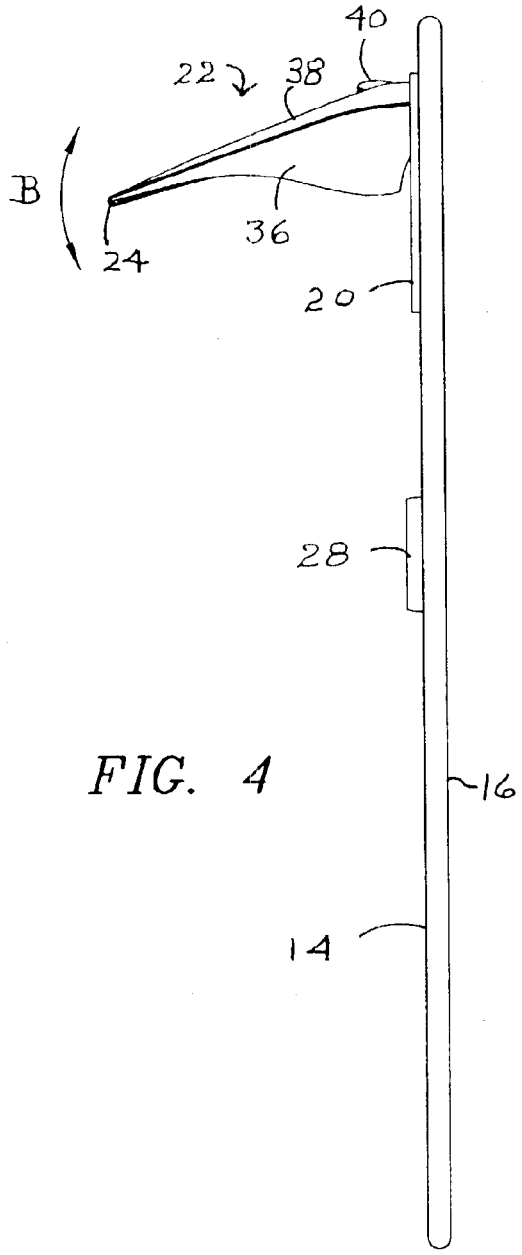
FIG. 4 is a right side elevation of the device shown in FIG. 2.
Figure 5:
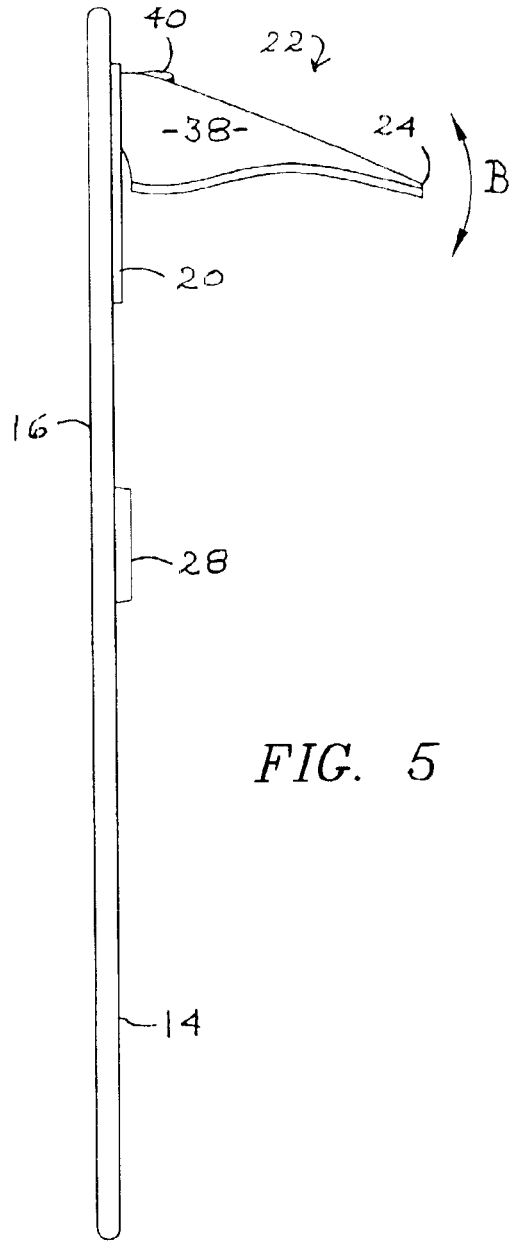
FIG. 5 is a left side elevation of the device shown in FIG. 2.
Figure 6:
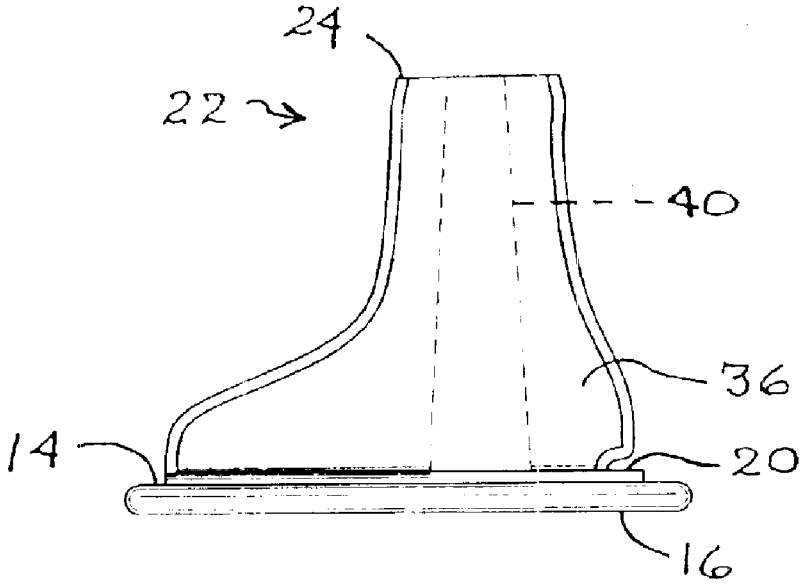
FIG. 6 is a bottom side elevation of the device shown in FIG. 2.

Turning to the views of FIGS. 2 and 3, FIG. 2 provides a top plan view of device 10, and FIG. 3 is a bottom plan view of device 10, showing bottom surface 16. In FIG. 2, rotation of foot base plate 20 around pivot pin 18 is indicated by double headed arrow A. In that view one can also see that foot base plate lock 30 comprises, in this preferred embodiment, a lock tab 32 that is releaseably engageable with lock detents formed on a segment of foot base plate 20 in operative relation to lock tab 32. Depressing lock tab 32 permits rotation of foot base plate 20 as indicated by arrow A, and releasing lock tab 32 will effectively "lock" foot base plate 20 into position by engagement of lock tab 32 with one or more of the lock detents 34.

Considering the views of both FIGS. 1 and 2, one can also see that segment 24 of ankle support 22 includes an inner surface 36 and an outer surface 38. While not shown in the drawings, it is to be understood that the user's rear foot would be placed on foot base plate 20 such that portions of the foot and ankle would be into contact with inner surface 36 of ankle support 22.

Figure 7:
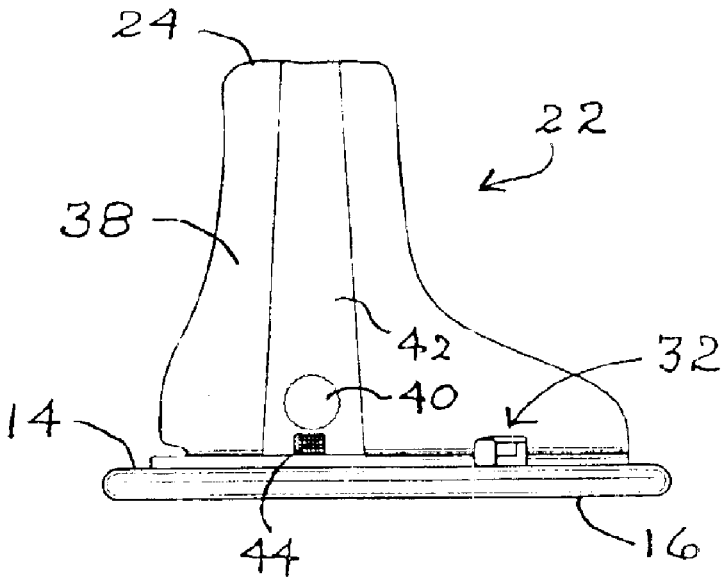
FIG. 7 is a top side elevation of the device shown in FIG. 2.

Turning to the views of FIGS. 4–7, side views and end views of device 10 are provided. Considering, first, the end view of FIG. 7, device 10 further comprises means whereby segment 24 of ankle support 22 may be angularly adjusted with respect to a plane that is substantially normal to top surface 14 of platform 12. This angular adjustment is indicated by double headed arrow B in the views of FIGS. 4 and 5. The adjustment is accomplished by rotating adjustment knob 40 causing a screw (not shown) attached to knob 40 to press against or move away from strip 42 which extends along the height of outer surface 38 as shown in FIG. 7, thereby resulting in angular movement of ankle support 22 as indicated by arrow B. This adjustment, like the rotatable adjustment provided around pivot pin 18, insures a correct engagement of the user's foot with a base plate 20 and ankle support 22.

Also visible in the view of FIG. 7 is strain gauge 44. Strain gauge 44 is preferably mounted to strip 42 on the outer surface 38 of ankle support 22 for receiving and measuring force applied to ankle support 22 by the user of device 10 in the course of making a golf swing. This force is translated to strain gauge 44 by pressure applied by the user's foot and ankle to inner surface 36 of ankle support 22 as the golf swing is made.

Strain gauge 44 may be selected from any of a variety of such instruments as are well known and readily available in the marketplace.

The output of strain gauge 44 is transmitted through conductors (not shown) to indicator 28. As shown in the view of FIG. 2, indicator 28 is disposed on top surface 14 of platform 12 such that indicator 28 is readily visible to a user of device 10 as the golf swing is practiced. Indicator 28 preferably comprises a plurality of indicator lights 46. Circuitry is provided such that at least one light 46 will be illuminated when the user is properly positioned on device 10 with his or her rear foot properly positioned on base plate 20 and adjacent ankle support 22. In the course of the golf swing, weight will shift to the user's rear foot, causing pressure to inner surface 36. This pressure is sensed by strain gauge 44 and a signal is transmitted to indicator- 28, causing one or more additional lights 46 to be illuminated. In the preferred embodiment, a first series of lights 46 are preferably green, and a second series of lights 46 are yellow. One or more of the lights 46 may be red. In use, weight shift during the golf swing sufficient to illuminate green lights is indicative of proper weight shift during the golf swing. Illumination of one or more yellow lights, while indicating a greater weight shift, may still be considered acceptable. Too much weight shift, resulting in even more pressure on inner surface 36, would be indicated as unacceptable by the illumination of one or more red lights. Of course, it is to be understood that the scope of this invention is not to be limited to any particular number of lights, nor their color. Rather, the structure of the device of this invention is intended to provide relatively instant feedback to the user about his or her swing balance, weight shift, and leg movement. In this preferred embodiment, after each swing, indicator lights 46 remain lit for sufficient time for the user to observe their status and the weight shift characteristics of the swing, as measured by strain gauge 44. Circuitry is provided whereby indicator 28 and strain gauge 44 will then reset for the next swing. Device 10 may be battery-operated, or connected directly to a source of electricity. The electrical connections and circuitry are state-of-the-art, and readily available. Most frequently, the preferred embodiment would be battery-operated to enhance the portability and utility of device 10.

It will thus be seen that the objects set forth above, among those made apparent from the preceding description, are efficiently attained, and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described,

What is claimed is:

1. A leg positioning and training device for golfers, said device comprising:

a platform comprising a top surface and a bottom surface;

a foot base plate rotatably mounted to said top surface of said platform;

an ankle support attached to said foot base plate, said ankle support comprising a segment extending upwardly from said foot base plate, said segment of said ankle support being angularly adjustable with respect to a plane substantially normal to said top surface of said platform;

a strain gauge operatively attached to said segment of said ankle support whereby force applied to said segment of said ankle support may be detected; and, an indicator operatively connected to said strain gauge, said indicator being disposed on said top surface of said platform such that said indicator is visible to a user of said device, whereby an indication of force applied to said segment of said ankle support by the user may be observed.

2. A device as in claim 1 wherein said segment of said ankle support comprises an inner surface and an outer surface, said strain gauge being disposed on said outer surface of said segment of said ankle support whereby said strain gauge detects force applied to said inner surface of said segment of said ankle support.

3. A device as in claim 2 further comprising a foot base plate lock disposed on said top surface of said platform in engaging relation to said foot base plate, whereby said foot base plate may be fixed to prevent rotation thereof with respect to said top surface of said platform.

4. A device as in claim 3 wherein said foot base plate lock is releaseable.

5. A device as in claim 4 wherein said platform is a rectangle.

6. A device as in claim 5 further comprising at least one aperture formed through said platform in spaced apart relation to an edge of said rectangle.

7. A device as in claim 5 wherein said foot base plate is mounted to said top surface of said platform substantially adjacent one of the shorter sides of said rectangle.

* * * * *